US010495367B2

(12) United States Patent
Liengaard et al.

(10) Patent No.: US 10,495,367 B2
(45) Date of Patent: Dec. 3, 2019

(54) REFRIGERATION APPLIANCE WITH A HEAT CIRCUIT

(71) Applicant: BSH HAUSGERAETE GMBH, Munich (DE)

(72) Inventors: Niels Liengaard, Ulm (DE); Matthias Mrzyglod, Ulm (DE); Andreas Vogl, Haunsheim (DE)

(73) Assignee: BSH Hausgeraete GmbH, Munich (DE)

( * ) Notice: Subject to any disclaimer, the term of this patent is extended or adjusted under 35 U.S.C. 154(b) by 26 days.

(21) Appl. No.: 15/532,520

(22) PCT Filed: Nov. 18, 2015

(86) PCT No.: PCT/EP2015/077014
§ 371 (c)(1),
(2) Date: Jun. 2, 2017

(87) PCT Pub. No.: WO2016/087210
PCT Pub. Date: Jun. 9, 2016

(65) Prior Publication Data

US 2017/0343266 A1 Nov. 30, 2017

(30) Foreign Application Priority Data

Dec. 2, 2014 (DE) ..... 10 2014 224 669

(51) Int. Cl.
*F25D 16/00* (2006.01)
*F25B 23/00* (2006.01)
(Continued)

(52) U.S. Cl.
CPC ..... *F25D 16/00* (2013.01); *F25B 1/00* (2013.01); *F25B 23/00* (2013.01); *F25B 23/006* (2013.01); *F25B 25/00* (2013.01); *F25B 25/005* (2013.01); *F25D 17/02* (2013.01); *F25D 19/006* (2013.01); *F25D 23/003* (2013.01); *F25D 29/00* (2013.01);
(Continued)

(58) Field of Classification Search
CPC ..... F25D 19/006; F25B 41/00; F25B 23/003; F25B 23/00; F25B 25/00; F25B 25/005
See application file for complete search history.

(56) References Cited

U.S. PATENT DOCUMENTS 6,067,814 A 5/2000 Imeland
2008/0156028 A1* 7/2008 Cur ..... F25B 25/00 62/203

FOREIGN PATENT DOCUMENTS

DE 102012207683 A1 11/2013
EP 1692437 A1 * 8/2005 ..... F25B 9/14
(Continued)

*Primary Examiner* — Keith M Raymond
*Assistant Examiner* — Nael N Babaa
(74) *Attorney, Agent, or Firm* — Laurence A. Greenberg; Werner H. Stemer; Ralph E. Locher

(57) ABSTRACT

A refrigeration appliance includes a refrigerant circuit having a heat exchanger. The refrigeration appliance also includes a heat circuit. The heat exchanger is thermally coupled to the heat circuit by a coupling element. The coupling element is mechanically connected to the heat circuit by a detachable connection. The detachable connection may be a force-locking connection, in particular a screw connection, a plug-in connection or a form-locking connection, in particular a snap-on connection.

13 Claims, 3 Drawing Sheets

(51) Int. Cl.

| | |
|---|---|
| ***F25B 25/00*** | (2006.01) |
| ***F25D 17/02*** | (2006.01) |
| ***F25D 19/00*** | (2006.01) |
| ***F25B 1/00*** | (2006.01) |
| ***F25D 23/00*** | (2006.01) |
| ***F25D 29/00*** | (2006.01) |

(52) U.S. Cl.
CPC .... *F25B 2339/047* (2013.01); *F25D 2700/12* (2013.01)

(56) References Cited

FOREIGN PATENT DOCUMENTS

| | | | |
|---|---|---|---|
| EP | 1692437 | A1 | 8/2006 |
| WO | 2005050105 | A1 | 6/2005 |

* cited by examiner

REFRIGERATION APPLIANCE WITH A HEAT CIRCUIT

BACKGROUND OF THE INVENTION

Field of the Invention

The present invention relates to a refrigeration appliance with a heat circuit.

During operation of a refrigeration appliance, the refrigerant in the refrigerant circuit is compressed by the refrigerant compressor, conveyed to the refrigerant condenser, then routed to the refrigerant evaporator and pumped by the refrigerant evaporator back to the refrigerant compressor. The said components form part of the closed refrigerant circuit, which is filled with refrigerant. Since the refrigerant evaporator and the refrigerant condenser make up a significant volume of the refrigerant circuit, the volume of the refrigerant circuit is increased by the said components, as a result of which the quantity of refrigerant in the refrigerant circuit increases.

SUMMARY OF THE INVENTION

The object of the present invention is to specify a refrigeration appliance, in which the refrigerant circuit has a reduced size.

This object is achieved by a subject matter having the features according to the independent claim. Advantageous embodiments form the subject matter of the dependent claims, the description and the drawings.

According to one aspect, the inventive object is achieved by a refrigeration appliance having a refrigerant circuit, which comprises a heat exchanger, and having a heat circuit, wherein the heat exchanger is thermally coupled to the heat circuit by means of a coupling element, and wherein the coupling element is mechanically connected to the heat circuit means of a detachable connection.

As a result, the technical advantage is achieved for instance in that an effective heat transfer between the refrigerant circuit and the heat circuit is enabled by using the heat circuit, which is in thermal contact with the heat exchanger of the refrigerant circuit by means of the coupling element. On account of the thermal coupling of the heat exchanger with the heat circuit, the function of the heat exchanger, such as e.g. heat absorption or heat output, can be moved at least partially from the refrigeration circuit to the heat circuit. As a result, the size of the refrigerant circuit and the quantity of refrigerant in the refrigerant circuit can be reduced. The detachable mechanical connection between the coupling element and the heat circuit enables the heat circuit, as a replaceable module of the refrigeration device, to be separated from the refrigerant circuit with minimal effort and e.g. replaced.

In a conventional refrigerant circuit, the refrigerant compressor, the refrigerant evaporator and the refrigerant condenser are fixed components of the refrigerant circuit. If one of the said components in a conventional refrigerant circuit is faulty, the refrigerant must first be removed, the component replaced, then the refrigerant circuit is closed again and the refrigerant is subsequently filled into the refrigerant circuit again.

In the present invention, the heat circuit is present as a separate circuit which is physically detached from the refrigerant circuit, and can be replaced with minimal effort without having to open the refrigerant circuit in the process. Only the detachable mechanical connection between the coupling element and the heat circuit needs to be released in order to remove the heat circuit from the refrigerant circuit. Therefore when various appliance variants of a refrigeration appliance type are manufactured for instance, a uniform refrigerant circuit can be installed in all appliance variants. Different types of heat circuit can be manufactured as separate modules for the various appliance variants of the refrigeration appliance type and can subsequently be easily installed in the various appliance variants of the refrigeration appliance type.

On account of the modular design of the refrigerant circuit, the size of the refrigerant circuit and the quantity of refrigerant in the refrigerant circuit can moreover be reduced, since the functions of components in the refrigerant circuit, such as e.g. the heat absorption of the refrigerant evaporator or the heat output of the refrigerant condenser, can be moved from the refrigerant circuit. The heat circuit is a circuit which is physically detached from the refrigerant circuit and is filled with a heat transport substance which differs from the refrigerant, and which is thermally coupled to the heat exchanger of the refrigerant circuit by the coupling element. For instance, the heat circuit can be thermally coupled to the refrigerant condenser of the refrigerant circuit in order to absorb and output heat from the refrigerant condenser. Alternatively the heat circuit can be thermally coupled to the refrigerant evaporator of the refrigerant circuit in order to absorb heat and to output the absorbed heat to the refrigerant evaporator.

A refrigeration appliance is understood in particular to mean a domestic refrigeration appliance, in other words a refrigeration appliance which is used for domestic purposes in households or in the field of gastronomy, and serves in particular to store food and/or beverages at specific temperatures, such as, for instance, a refrigerator, a freezer, a fridge/freezer, a chest freezer or a wine chiller.

In one advantageous embodiment of the refrigeration appliance, the detachable connection comprises a force-locking connection, in particular a screw connection, a plug-in connection or a form-locking connection, in particular a snap-on connection.

As a result, the technical advantage is achieved in that an effective thermal coupling between the heat exchanger and the heat circuit is ensured by the cited mechanical connections, wherein the mechanical connection between the coupling element and the heat circuit is detachable in order, if necessary, to remove the heat circuit.

Force-locking connections require a force on the surfaces to be connected to one another, wherein the mutual displacement of the connected surfaces is prevented provided the counter force effected by the static friction is not exceeded. A preferred force-locking connection comprises a screw connection. With a screw connection a screw has an outer thread, wherein the outer thread can be screwed into an inner thread of an absorption element, or wherein when being screwed in the screw furrows an inner thread channels into the absorption element itself in order to obtain a force-locking connection.

With a plug-in connection, a plug is inserted into a suitable absorption element and a coupling between the plug and the absorption element is achieved for instance in conjunction with an elastic sealing element.

Form-locking connections are produced by the interlocking of at least two connecting partners. A preferred form-locking connection comprises a snap-on connection, as an interlocking holding apparatus, in which a pin is inserted into a depression and is fixed in the depression.

On account of the cited types of connections, an effective mechanical connection can be realized between the heat exchanger and the heat circuit by the coupling element, said mechanical connection, conversely to a material-bonding connection, e.g. a welded connection, nevertheless being detachable. The detachable mechanical connection between the coupling element and the heat circuit can be produced by an expenditure of effort, by, for instance, the pin of a snap-on connection being inserted into the corresponding depression and the pin in the depression being fixed by a latching. Without a force which is directed in a specific direction, the mechanical connection remains and ensures an effective thermal coupling between the refrigerant circuit and the heat circuit during operation of the refrigeration device. The mechanical connection can however be released by a force which is directed in a specific direction. By releasing the detachable mechanical connection, the heat circuit, e.g. in the event of fault, can be removed from the refrigeration appliance and replaced.

The force-locking connection, e.g. screw connection, the plug-in connection and the form-locking connection, e.g. snap-on connection, can be realized both on the side of the coupling element and also on the side of the heat circuit. Therefore, the pin of a snap-on connection can either be attached to the coupling element or to the heat circuit for instance, and the corresponding absorption element can correspondingly alternately either be attached to the heat circuit or to the coupling element, in order to achieve an effective detachable mechanical connection. Alternatively, the cited force-locking, plug-in and form-locking connections can also comprise combinations of the various connections.

In a further advantageous embodiment of the refrigeration appliance, the heat exchanger is a refrigerant evaporator or a refrigerant condenser.

As a result, the technical advantage is achieved in that during operation of the refrigeration appliance, a refrigerant evaporator or a refrigerant condenser in a refrigerant circuit absorbs heat or outputs heat, and the heat can be transmitted between the refrigerant circuit and the heat circuit. The refrigerant evaporator is a heat exchanger, in which the liquid refrigerant is evaporated by heat absorption from the heat circuit that is in thermal contact with the heat exchanger. The refrigerant condenser is a heat exchanger, in which the evaporated refrigerant is condensed by outputting heat to the heat circuit that is in thermal contact with the heat exchanger.

In a further advantageous embodiment of the refrigeration appliance, the heat exchanger is a refrigerant evaporator, wherein the heat circuit is embodied to output a quantity of heat from a cooling region of the refrigeration appliance and to the refrigerant evaporator.

As a result, the technical advantage is achieved in that the quantity of heat absorbed by the refrigerant evaporator is discharged by the heat circuit out of the cooling region of the refrigeration appliance, as a result of which the cooling region of the refrigeration appliance is cooled. The heat transport substance of the heat circuit absorbs the quantity of heat in the cooling region, is heated as a result and can then output the absorbed quantity of heat to the refrigerant evaporator of the refrigerant circuit. Outputting the quantity of heat causes the heat transport substance in the heat circuit to cool. The cooled heat transport substance is thus available again to absorb a quantity of heat from the cooling region of the heat circuit. An effective heat transfer from the cooling region of the refrigeration appliance to the refrigerant evaporator is thus achieved.

In a further advantageous embodiment of the refrigeration appliance, the heat exchanger is a refrigerant condenser, which is embodied to output a quantity of heat to the heat circuit, wherein the heat circuit is embodied to output the absorbed quantity of heat to the outer region of the refrigeration appliance.

As a result, the technical advantage is achieved in that the quantity of heat output by the refrigerant condenser can be effectively discharged by the heat circuit to the outer region of the refrigeration appliance. The heat transport substance of the heat circuit is heated by absorbing the quantity of heat from the refrigerant condenser. In one region of the heat circuit, preferably in the vicinity of the rear wall of the refrigeration appliance, the heated heat transport substance can output the absorbed quantity of heat to the outer region of the refrigeration appliance. Outputting heat results in the heat transport substance in the heat circuit cooling. As a result, the cooled heat transport substance is once again available to absorb a quantity of heat from the refrigerant condenser. Therefore, an effective discharge of heat by the refrigerant condenser out of the refrigeration appliance can be achieved by the heat circuit.

In a further advantageous embodiment of the refrigeration appliance, the heat exchanger is a refrigerant evaporator, wherein the refrigerant circuit comprises a further heat exchanger, which is a refrigerant condenser, wherein the refrigeration appliance comprises a further heat circuit, wherein the heat circuit is embodied to absorb a quantity of heat from a cooling region of the refrigeration appliance and to output the same to the refrigerant evaporator, in order to supply the quantity of heat to the refrigerant circuit, wherein the refrigerant condenser is embodied to output the quantity of heat supplied to the refrigerant circuit to the further heat circuit, and wherein the further heat circuit is embodied to output the absorbed quantity of heat to the outer region of the refrigeration appliance.

As a result, the technical advantage is achieved in that on account of the thermal coupling of two heat exchangers of the refrigerant circuit with two heat circuits, a particularly effective refrigerant circuit can be provided which ensures an effective cooling of the cooling region of the refrigeration appliance. The quantity of heat can be supplied from the cooling region of the refrigeration appliance to the refrigerant evaporator by the heat circuit, whereas the quantity of heat is discharged from the refrigerant condenser by the further heat circuit. Therefore the functions of the refrigerant evaporator and the refrigerant condenser can be moved by the thermal coupling with the heat circuit or with the further heat circuit, to the respective heat circuit. As a result, it is not only the effectiveness of the refrigerant circuit that is increased, but the size of the refrigerant circuit can also be reduced, as a result of which the quantity of refrigerant in the refrigerant circuit can in particular be reduced.

In a further advantageous embodiment of the refrigeration appliance, the heat exchanger comprises an inner pipe for routing the refrigerant, wherein the inner pipe has a porous or serrated surface structure.

As a result, the technical advantage is achieved that on account of the porous or serrated surface structure of the inner pipe of the heat exchanger, a particularly effective heat transfer is realized between the heat exchanger and the heat circuit. A porous surface structure can be realized by attaching a porous material to the surface of the inner pipe. A serrated surface structure comprises a surface structure with elevations, e.g. ribs, or with depressions, e.g. grooves. The surface of the inner pipe is enlarged by the porous or serrated surface structure of the inner pipe of the heat exchanger. The enlargement of the surface in turn increases the efficiency of the heat transfer between the refrigerant flowing through the inner pipe and the heat circuit, since the heat circuit can efficiently absorb large quantities of heat from the heat exchanger or efficiently output the same to the heat exchanger. On this account a minimal length of the inner pipe with a porous or serrated surface structure is already sufficient to ensure an adequate heat transfer between the heat exchanger and the heat circuit.

In a further advantageous embodiment of the refrigeration appliance, the heat exchanger is embodied as a thermally conducting plate.

As a result, the technical advantage is achieved in that by using a thermally conducting plate as a heat exchanger of the refrigerant circuit, the size of the refrigerant circuit can be reduced, and as a result less refrigerant is required in the refrigerant circuit. The function of the heat exchanger can be moved to the heat circuit on account of the thermal coupling of the heat circuit with the heat exchanger of the refrigerant circuit. The heat circuit can either discharge heat from the refrigerant circuit or can supply heat to the refrigerant circuit. If the heat exchanger is embodied as a thermally conducting plate, the thermal coupling between the refrigerant circuit and heat circuit is sufficient to ensure an effective heat transfer between the two circuits.

In a further advantageous embodiment of the refrigeration appliance, the coupling element comprises a thermally conducting plate.

As a result, the technical advantage is achieved in that a thermally conducting plate as a coupling element ensures an effective thermal coupling between the heat exchanger and the heat circuit, as a result of which an effective heat transfer is ensured between the heat exchanger and the heat circuit. The coupling element is moreover mechanically connected by means of a detachable connection to the heat circuit. A plate as a coupling element is thus suited to ensuring an effective mechanical connection between the coupling element and the heat circuit, since a snap-on connection can be effectively attached to the plate for instance.

In a further advantageous embodiment of the refrigeration appliance, the heat circuit comprises a thermosiphon, a ventilated thermosiphon or a heating pipe, preferably a ventilated thermosiphon.

As a result the technical advantage is achieved in that an effective and energy-saving heat transfer is enabled by the thermosiphon or heating pipe. A thermosiphon is a passive heat circuit, which enables a heat exchange by using the natural convection in a vertical, closed fluid circuit. The thermosiphon contains a heat transport substance, which is heated in the lower region of the thermosiphon, as a result of which the heat transport substance is evaporated, as a result of which this rises in the vertical fluid circuit. In the upper region of the thermosiphon, this causes the heat transport substance to condense and heat to be output, as a result of which the heat transport substance in the vertical fluid circuit sinks on account of the force of gravity. A thermosiphon therefore contains a two-phase gas mixture with a constant pressure and a constant temperature and is operated by a temperature difference in various outer regions of the thermosiphon.

A ventilated thermosiphon is particularly preferred since in addition to the heat circuit, a ventilated thermosiphon comprises a fan, which is embodied to supply an air flow to the heat circuit of the thermosiphon. By supplying the air flow to a point in the heat circuit at which heat is absorbed or output, an effective heat transfer can be achieved by the thermosiphon. As a result, the effectiveness of the heat transport of the ventilated thermosiphon can be increased in particular.

A heating pipe is likewise a passive heat circuit, which enables a heat exchange by a heat transport substance in a closed pipe. The effectiveness of the heating pipe is similar to the effectiveness of the thermosiphon, only that the ends of the heating pipe are not connected to one another and no pipe circuit is therefore available. Instead, the inner walls of the heating pipe are equipped with a coating, which has a high capillary effect. If, on account of a temperature difference between regions outside of the heating pipe, the heat transport substance flows in a core region of the pipe, then, on account of the capillary effect of the coating, the heat transport substance can flow back to the exterior of the inner region of the pipe.

In a further advantageous embodiment of the refrigeration appliance, the heat circuit contains a heat transport substance, which comprises an alkane, a fluorocarbon, an alcohol or water, preferably isobutane, an alcohol or water.

As a result, the technical advantage is achieved in that the cited heat transport substances have advantageous heat-transporting properties. For this reason alkanes, fluorocarbons, alcohols and water are particularly suited to the use of a two-phase mixture in a heat circuit of a refrigeration appliance. Isobutane is an alkane and is used in conventional refrigerant circuits as a refrigerant and can also preferably be used as a heat transport substance in a heat circuit. Alcohol and water have proven to be particularly advantageous heat transport substances, which are suited to use in a heat circuit, and moreover are minimally harmful. On account of the low freezing point of alcohol, contrary to water, alcohol is particularly suitable in a heat circuit in which temperatures close to 0° exist, since water could freeze in a heat circuit with such a low temperature. By contrast, water is suitable as an advantageous heat transport substance at temperatures which than the freezing temperature of water.

In a further advantageous embodiment of the refrigeration appliance, the heat circuit comprises a valve, wherein the valve is embodied to release the heat circuit in a first position and to close the heat circuit in a second position.

As a result, the technical advantage is achieved in that the heat circuit can be released or closed by the valve, as required, as a result of which the heat circuit can be switched on or switched off. As a result, the cooling power of the refrigeration appliance can be controlled efficiently by regulating the valve as a function of the required cooling.

In a further advantageous embodiment of the refrigeration appliance, the refrigeration appliance comprises a temperature sensor for detecting a temperature value of a cooling region of the refrigeration appliance, and a valve controller for controlling the valve, wherein the valve controller is embodied to control the valve as a function of the detected temperature value.

As a result, the technical advantage is achieved in that as a function of the temperature value detected by the temperature sensor, the cooling of the cooling region of the refrigeration appliance can be controlled more effectively by means of the valve controller depending on the cooling power required. If the temperature value in the cooling region of the refrigeration appliance exceeds a specific temperature threshold, the valve controller can open the valve in order to release the heat circuit and to achieve an effective cooling of the cooling region. If the temperature value in the cooling region of the refrigeration appliance sinks, the valve controller can close the valve in order to close the heat circuit, as a result of which an unnecessary cooling of the cooling region is prevented.

In a further advantageous embodiment of the refrigeration appliance, the cooling region has a refrigerator compartment, wherein the refrigerant circuit is thermally coupled to the refrigerator compartment, wherein the temperature sensor is embodied to detect a temperature value in the refrigerator compartment and wherein the valve controller is embodied to control the valve as a function of the detected temperature value.

As a result, the technical advantage is achieved in that a specific temperature regulation of one or a number of different refrigerator compartments is enabled in a cooling region of the refrigeration appliance. The cooling region of a refrigeration appliance may comprise at least one refrigerator compartment, in particular one, two, three, four, five, six, seven, eight, nine or ten refrigerator compartments. If the temperature sensor is embodied such that it can detect temperature values in the various refrigerator compartments of the refrigeration appliance, the valve controller can determine whether the detected temperature value in the refrigerator compartment corresponds to the desired temperature value in the refrigerator compartment or, if applicable, has to be adjusted. As a result of the heat circuit being thermally coupled to the refrigerator compartment, there is the option of achieving a targeted cooling of the various refrigerator compartments of the refrigeration appliance by means of a controller of the valve of the heat circuit.

In a further advantageous embodiment of the refrigeration appliance, the refrigerator compartment of the refrigeration appliance comprises a freezer chamber.

As a result, the technical advantage is achieved in that a particularly effective cooling of the frozen chamber of the refrigeration appliance can be achieved on account of the thermal coupling of the heat circuit with the freezer chamber of the refrigeration appliance, combined with the temperature detection by the temperature sensor and combined with the valve controller.

BRIEF DESCRIPTION OF THE SEVERAL VIEWS OF THE DRAWING

Further exemplary embodiments are explained with respect to the appended drawings, in which.

DESCRIPTION OF THE INVENTION

Figure 1:
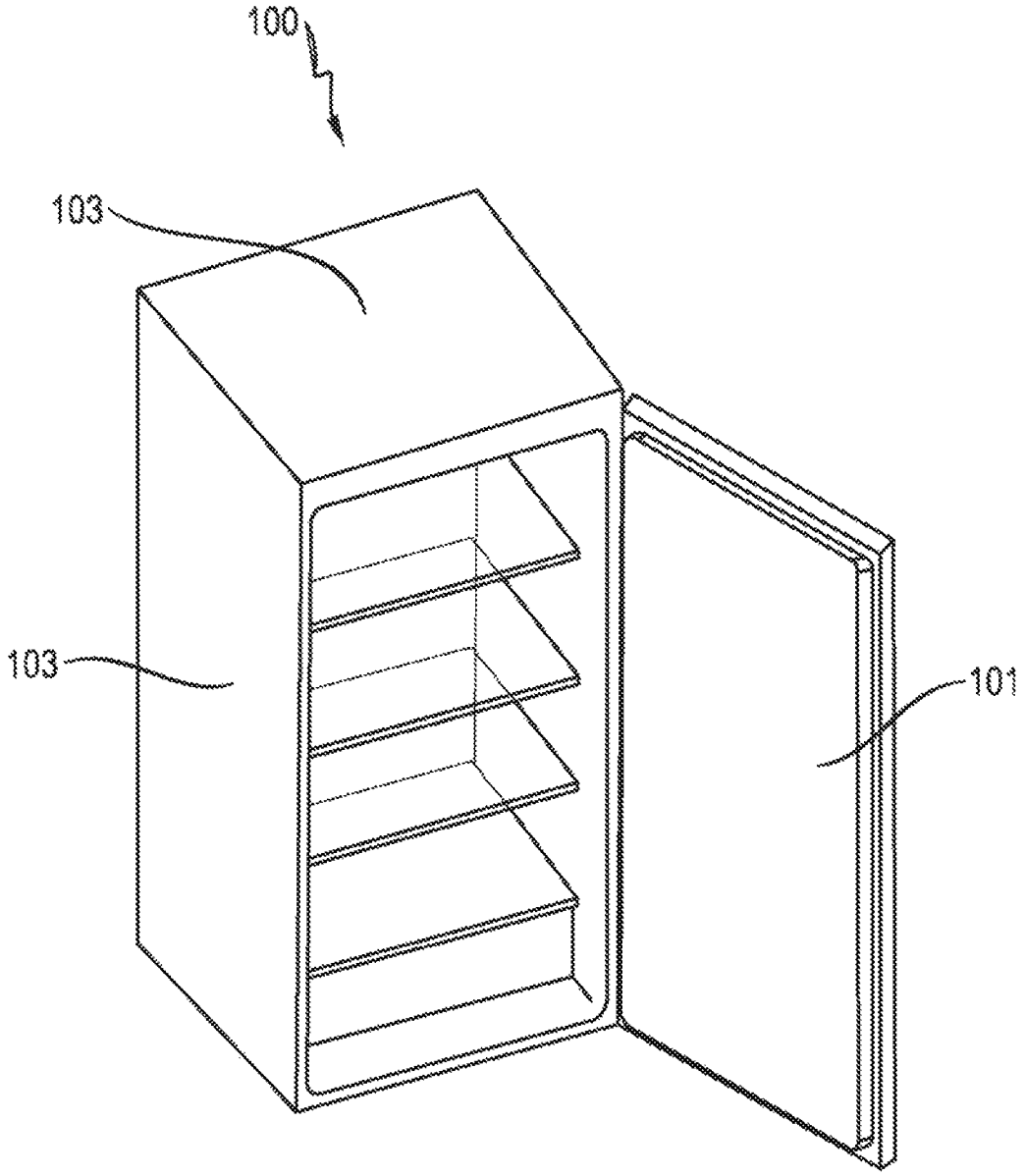
FIG. 1 shows a schematic representation of a refrigeration appliance.

FIG. 1 shows a general refrigeration appliance 100, in particular a refrigerator, which can be closed by a refrigeration appliance door 101 and has a frame 103.

Figure 2:
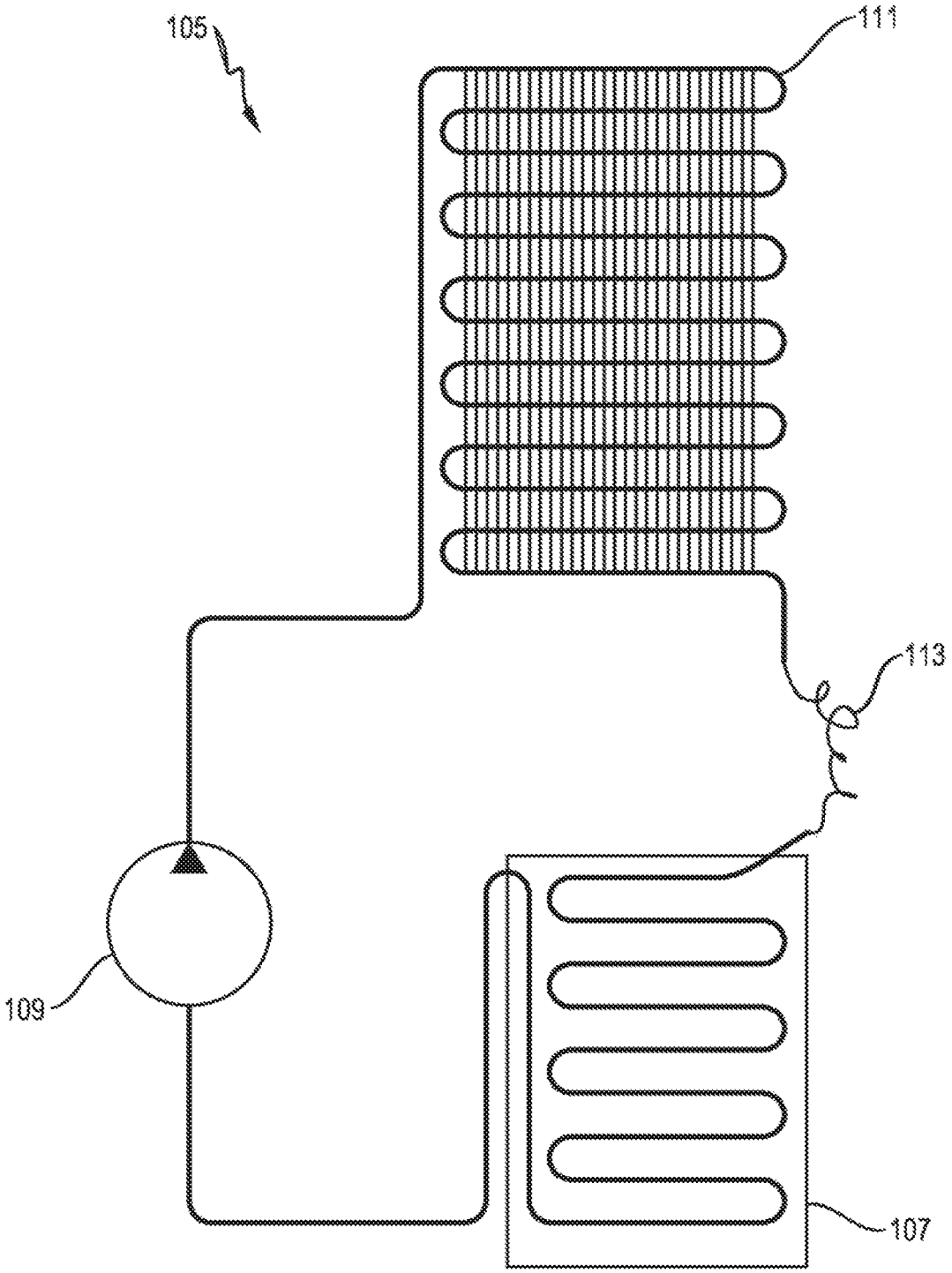
FIG. 2 shows a schematic representation of a refrigerant circuit.

FIG. 2 shows a refrigerant circuit of a refrigeration appliance as a comparative example. The refrigerant circuit 105 comprises a refrigerant evaporator 107, a refrigerant compressor 109, a refrigerant condenser 111 and a throttle organ 113. After expansion of the liquid refrigerant by absorbing heat from the medium to be cooled, e.g. the air in the interior of the refrigerator, the refrigerant evaporator 107 evaporates the refrigerant. The refrigerant compressor 109 is a mechanically operated component, which sucks in refrigerant vapor from the refrigerant evaporator 107 and strikes the refrigerant condenser 111 at a higher pressure. On account of the refrigerant condenser 111, the evaporated refrigerant is condensed by outputting heat to an external cooling medium, e.g. the ambient air. The throttle organ 113 is an apparatus for completely reducing the pressure by means of cross-sectional tapering.

The refrigerant is a fluid, which is used to transfer heat in the cold-generating system, which absorbs heat at low temperatures and at low pressure of the fluid and outputs heat at a higher temperature and higher pressure of the fluid, wherein changes in the state of the fluid are usually included.

Figure 3:
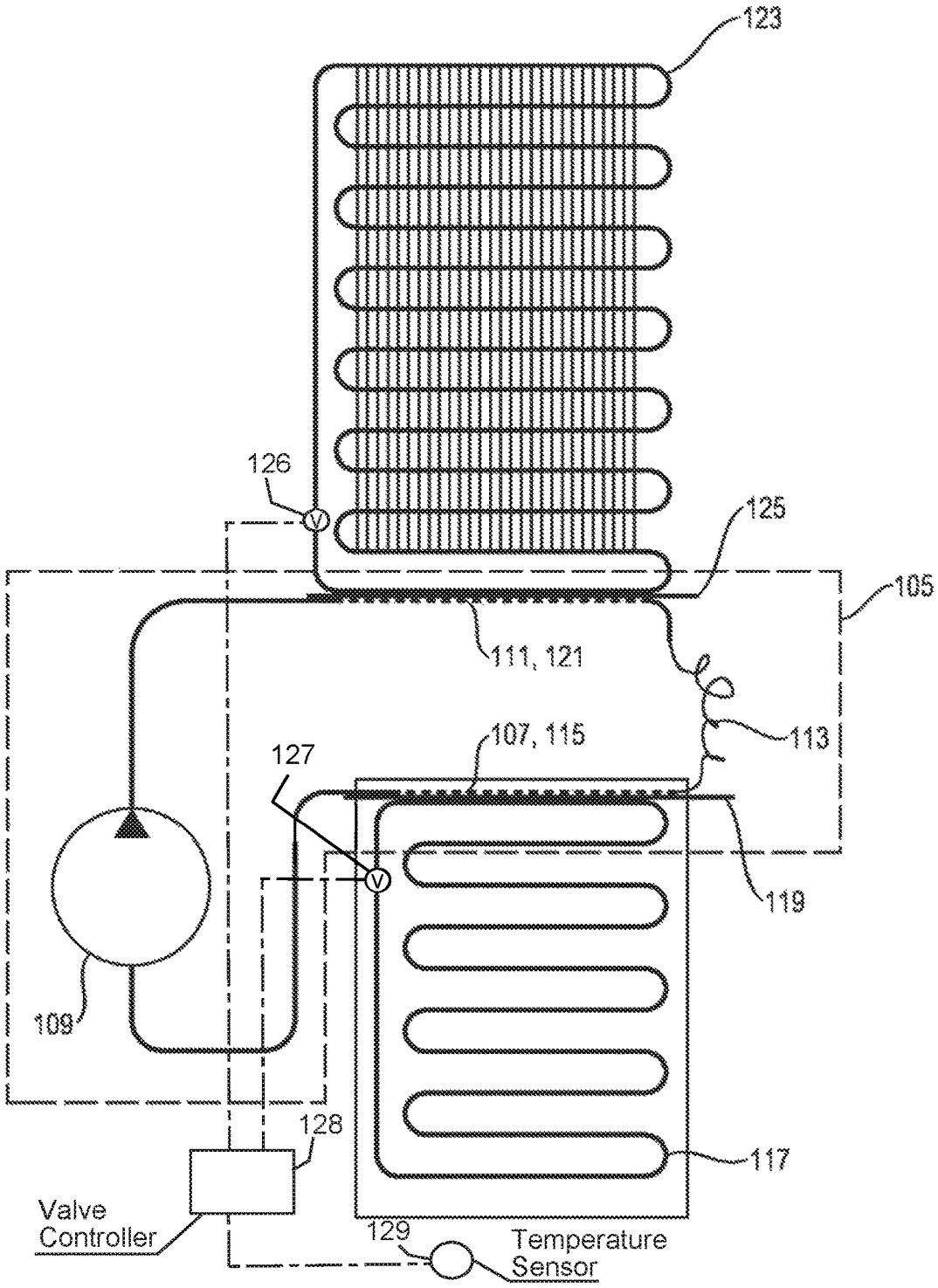
FIG. 3 shows a schematic representation of a refrigerant circuit with a heat circuit and with a further heat circuit in a refrigeration appliance.

FIG. 3 shows a schematic representation of a refrigerant circuit with a heat circuit and with a further heat circuit in a refrigeration appliance. The refrigerant circuit 105 comprises a refrigerant evaporator 107, a refrigerant compressor 109, a refrigerant condenser 111 and a throttle organ 113, wherein the refrigerant evaporator 107 is embodied as a heat exchanger 115 and the refrigerant condenser 111 is embodied as a further heat exchanger 121.

The refrigeration appliance 100 comprises a heat circuit 117 physically detached from the refrigerant circuit 105, which can be embodied as a thermosiphon and is thermally coupled to the refrigerant evaporator 107, which is embodied as a heat exchanger 115, by a coupling element 119, in order to transfer heat from the heat circuit 117 to the refrigerant evaporator 107. The refrigerant evaporator 107 or the coupling element 119 can be embodied as a thermally conducting plate. The coupling element 119 is mechanically connected to the heat circuit 117 by means of a detachable connection, wherein the detachable connection can comprise a force-locking connection, in particular a screw connection, a plug-in connection or a form-locking connection, in particular a snap-on connection.

The dashed lines used to illustrate the heat exchanger 115 indicate the thermal but not physical connection of the heat circuit 117 and the refrigerant circuit 105 discussed above.

The heat circuit 117 is filled with a heat transport substance, in particular an alcohol, and is embodied to absorb heat from a cooling region of the refrigeration appliance 100 in order to obtain a heated heat transport substance. A temperature gradient exists in the heat circuit 117, as a result of which the heat transport substance is present in a liquid aggregate state in the lower region of the heat circuit 117. The heat transport substance is present in a gaseous aggregate state in the upper region of the heat circuit 117. If a quantity of heat is supplied to the lower region of the heat circuit 117 and the heat transport substance absorbs the quantity of heat, this results in the heat transport substance heating. This heating causes the heat transport substance to evaporate and rise upward in the heat circuit 117 as a gaseous heat transport substance. The heated heat transport substance can output the absorbed quantity of heat to the refrigerant evaporator 107 of the refrigerant circuit 105 by means of the coupling element 119. The output of heat results in the heat transport substance in the heat circuit 117 cooling down, as a result of which the heat transport substance condenses and, as a liquid in the heat circuit 117, sinks downward. If the cooled liquid substance has reached the lower region of the heat circuit 117, this is once again available for the absorption of a quantity of heat. An effective heat transport can thus be enabled in the heat circuit 117 by means of the heat transport substance.

The quantity of heat output to the refrigerant evaporator 107 is absorbed by the refrigerant in the refrigerant circuit 105. The heated refrigerant is then compressed by the refrigerant compressor 109 in the refrigerant circuit 105 and forwarded at a higher pressure to the refrigerant condenser 111. The refrigerant condenser 111 is embodied as a further heat exchanger 121, in order to discharge the quantity of heat from the refrigerant, as a result of which the refrigerant in the refrigerant circuit 105 is condensed. The refrigerant condenser 111 can be embodied as a thermally conducting plate.

The refrigerant condenser 111 outputs the quantity of heat absorbed by the refrigerant via a further coupling element 125 to a further heat circuit 123. The refrigerant condenser 111 is thermally coupled to the further heat circuit 123 by the further coupling element 125, wherein the further coupling element 125 is mechanically connected to the further heat circuit 123 by means of a detachable connection. The further coupling element 125 can comprise a thermally conducting plate. The further heat circuit 123 is based on a mode of operation that is similar to the heat circuit 117. The further heat circuit 123 is filled with a heat transport substance, which heats up by the heat absorption by the refrigerant condenser 111. On account of the present temperature gradients, the heated heat transport substance in the further heat circuit 123 rises upward. In the upper region of the further heat circuit 123, the heated heat transport substance can output the absorbed quantity of heat to the outer region of the refrigeration appliance 100. The heat output results in the heat transport substance in the further heat circuit 123 cooling down, as a result of which the heat transport substance condenses and, as a liquid in the further heat circuit 123, sinks downwards in order to be available again for the absorption of a quantity of heat from the refrigerant condenser 111. An effective heat transport by the heat transport substance can thus be enabled both by the heat circuit 117 and also by the further heat circuit 123.

The dashed lines used to illustrate the heat exchanger 121 indicate the thermal but not physical connection of the further heat circuit 123 and the refrigerant circuit 105 discussed above.

A technical advantage with the physical detachment of the heat circuit 117, 123 and refrigerant circuit 105 is that compared with conventional refrigeration appliances 100, the refrigerant circuit 105 can be reduced in size. As a result, a smaller quantity of refrigerant is required in the inventive refrigerant circuit 105.

In order to improve the heat transfer between the heat exchanger 115, 121 and the heat circuit 117, 123, the heat exchanger 115, 121 can comprise an inner pipe for guiding the refrigerant of the refrigerant circuit 105, wherein the inner pipe has a porous or serrated surface structure. The porous or serrated surface structure causes the surface of the inner pipe in the heat exchanger 115, 121 to enlarge. This measure increases the quantity of heat transmitted between the heat exchanger 115, 121 and the heat circuit 117, 123 on the side of the refrigerant circuit 105. Since the heat circuit 117, 123, embodied in particular as a thermosiphon, can absorb or output the large quantities of heat, a minimal length of the inner pipe is already sufficient to transfer the required quantity of heat between the heat exchanger 115, 121 and the heat circuit 117, 123.

The heat circuit 117, 123 can comprise a ventilated thermosiphon, since a ventilated thermosiphon can transfer a larger quantity of heat than a static thermosiphon. A ventilated thermosiphon comprises a fan, which routes an air flow to the thermosiphon, as a result of which the heat absorption or heat output of the ventilated thermosiphon can be effectively increased.

The heat circuit 117, 123 can comprise a valve 126, 127, by means of which the heat circuit 117, 123, if necessary, can be switched on or off, by the flow of heat transport substance either being released or interrupted by the valve. The valve 126, 127 can be controlled as a function of the temperature requirements in the refrigeration appliance 100 and performed for instance in combination with temperature sensors 129. The temperature sensors 129 can detect the temperature in specific regions of the refrigeration appliance 100. A controller 128 can control the flow of heat transport substance in the heat circuit 117, 123 as a function of the detected temperature by releasing or closing the valve 126, 127. The heat circuit 117, 123 can be embodied to discharge heat from a specific refrigerator compartment to be cooled, such as e.g. a freezer chamber.

A refrigeration appliance 100 which has a refrigerant circuit 105 with a reduced size and with a smaller quantity of refrigerant is thus realized by the present invention. By using the coupling element 119, 125, a detachable mechanical connection is realized between the coupling element 119, 125 and the heat circuit 117, 123. As a result, the heat circuit 117, 123 can be easily installed when the refrigeration appliance 100 is assembled. As a result, assembly of the refrigeration appliance 100 is simplified and the number of connecting points can be reduced. A detachable connection is advantageous if prefabricated assemblies, such as e.g. prefabricated heat circuits 117, 123, are supplied to the manufacturing lines during assembly of the refrigeration appliance 100. The various prefabricated heat circuits 117, 123 can then be connected and technically sealed with one another without a soldering or welding outlay.

On account of the physical detachment of the refrigerant circuit 105 from the heat circuit 117, 123, a modular delimitation of the functions of the refrigeration appliance 100 is possible. The refrigerant circuit 105 can thus be manufactured in large numbers and fixedly installed in various appliance types of the refrigeration appliance 100. The various designs of the heat circuit 117, 123 can then be easily connected to the refrigerant circuit 105 in the various appliance types. In the case of repair work, the heat circuit 117, 123 can be replaced with minimal effort.

All features shown and explained in conjunction with individual embodiments of the invention can be provided in a different combination in the inventive subject matter in order simultaneously to realize their advantageous effects.

The scope of protection of the present invention is provided by the claims and is not restricted by the features explained in the description or shown in the figures.

LIST OF REFERENCE CHARACTERS

100 Refrigeration appliance
101 Refrigeration appliance door
103 Frame
105 Refrigerant circuit
107 Refrigerant evaporator
109 Refrigerant compressor
111 Refrigerant condenser
113 Throttle organ
115 Heat exchanger
117 Heat circuit
119 Coupling element
121 Further heat exchanger
123 Further heat circuit
125 Further coupling element
126 Valve
127 Valve
128 Valve controller
129 Temperature sensor

The invention claimed is:

1. A refrigeration appliance, comprising:

a cooling region and an outer region of the refrigeration appliance;

a closed refrigerant circuit including a refrigerant compressor, a heat exchanger being a refrigerant evaporator and a further heat exchanger being a refrigerant condenser;

a heat circuit being configured to absorb a quantity of heat from said cooling region and to output the quantity of heat to said refrigerant evaporator in order to supply the quantity of heat to said refrigerant circuit;

a further heat circuit being configured to output the absorbed quantity of heat to said outer region of the refrigeration appliance;

said refrigerant condenser being configured to output the quantity of heat supplied to said refrigerant circuit to said further heat circuit;

said heat circuit and said further heat circuit being physically detached from said refrigerant circuit and said heat circuit and said further heat circuit being separate circuits from said refrigerant circuit, to facilitate replacement of said heat circuit and said further heat circuit without having to open said refrigerant circuit;

a coupler thermally coupling said heat exchanger to said heat circuit;

a further coupler thermally coupling said further heat exchanger to said further heat circuit;

a detachable connection mechanically connecting said coupler to said heat circuit; and a further detachable connection mechanically connecting said further coupler to said further heat circuit.

2. The refrigeration appliance according to claim 1, wherein said detachable connection is a force-locking connection, a screw connection, a plug-in connection, a form-locking connection or a snap-on connection.

3. The refrigeration appliance according to claim 1, wherein said heat exchanger is a refrigerant evaporator, and said heat circuit is configured to absorb a quantity of heat from a cooling region of the refrigeration appliance and to output the quantity of heat to said refrigerant evaporator.

4. The refrigeration appliance according to claim 1, wherein said heat exchanger is a refrigerant condenser being configured to output a quantity of heat to be absorbed by said heat circuit, and said heat circuit is configured to output the absorbed quantity of heat to an outer region of the refrigeration appliance.

5. The refrigeration appliance according to claim 1, wherein said heat exchanger includes an inner pipe for routing a refrigerant, said inner pipe having a porous or serrated surface structure.

6. The refrigeration appliance according to claim 1, wherein said heat exchanger is a thermally conducting plate.

7. The refrigeration appliance according to claim 1, wherein said coupler includes a thermally conducting plate.

8. The refrigeration appliance according to claim 1, wherein said heat circuit includes a thermosiphon, a ventilated thermosiphon, a heating pipe or a ventilated heating pipe.

9. The refrigeration appliance according to claim 1, wherein said heat circuit contains a heat transport substance including an alkane, a fluorocarbon, an alcohol, water or isobutene.

10. The refrigeration appliance according to claim 1, wherein said heat circuit includes a valve configured to release said heat circuit in a first position and to close said heat circuit in a second position.

11. The refrigeration appliance according to claim 10, which further comprises:

a cooling region of the refrigeration appliance;

a temperature sensor for detecting a temperature value of said cooling region; and a valve controller for controlling said valve, said valve controller being configured to control said valve as a function of the detected temperature value.

12. The refrigeration appliance according to claim 11, wherein:

said cooling region has a refrigerator compartment;

said heat circuit is thermally coupled to said refrigerator compartment;

said temperature sensor is configured to detect a temperature value in said refrigerator compartment; and said valve controller is configured to control said valve as a function of the detected temperature value.

13. The refrigeration appliance according to claim 12, wherein said refrigerator compartment includes a freezer chamber.

* * * * *